US007762856B2

(12) United States Patent
Friesen et al.

(10) Patent No.: US 7,762,856 B2
(45) Date of Patent: Jul. 27, 2010

(54) PUSH ON TERMINAL ASSEMBLY

(75) Inventors: Charles Scott Friesen, Winnipeg (CA); Irene Zofia Wasilewski, Winnipeg (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/251,236

(22) Filed: Oct. 14, 2008

(65) Prior Publication Data

US 2010/0093233 A1 Apr. 15, 2010

(51) Int. Cl.
*H01R 13/187* (2006.01)

(52) U.S. Cl. ..... 439/843

(58) Field of Classification Search ..... 439/843–847, 439/879

See application file for complete search history.

(56) References Cited

U.S. PATENT DOCUMENTS

| | | | | |
|---|---|---|---|---|
| 1,640,189 | A | 8/1927 | Hamiel | |
| 3,980,387 | A | 9/1976 | Neidecker | |
| 4,033,664 | A | 7/1977 | Norman | |
| 4,120,556 | A * | 10/1978 | Waldron et al. | 439/682 |
| 4,911,660 | A | 3/1990 | Alf et al. | |
| 5,011,439 | A * | 4/1991 | Pawlicki | 439/847 |
| 5,775,960 | A | 7/1998 | Saito et al. | |
| 6,682,357 | B2 | 1/2004 | Sikora et al. | |
| 6,875,063 | B2 | 4/2005 | Zhao et al. | |
| 6,997,750 | B2 | 2/2006 | Johannes et al. | |
| 7,121,892 | B2 | 10/2006 | Johannes et al. | |
| 7,241,175 | B2 | 7/2007 | Johannes et al. | |
| 7,467,980 | B2 * | 12/2008 | Chiu | 439/843 |
| 2008/0207009 | A1 | 8/2008 | Osada | |

FOREIGN PATENT DOCUMENTS

| | | |
|---|---|---|
| JP | 06-325812 | 11/1994 |
| JP | 08-222330 | 8/1996 |

* cited by examiner

*Primary Examiner*—Michael C Zarroli
(74) *Attorney, Agent, or Firm*—Blank Rome LLP

(57) ABSTRACT

A terminal assembly includes a terminal and a barrel. The terminal has a coupling portion that fastens to a conductor, a mating portion with compression tabs arranged to form a channel, and an interlocking member on at least one of the compression tabs. The barrel is separate from the terminal and has a bore formed therethrough configured to receive the compression tabs of the mating portion. The barrel includes an interlocking member corresponding to the interlocking member of the at least one compression tab.

23 Claims, 8 Drawing Sheets

PUSH ON TERMINAL ASSEMBLY

FIELD OF THE INVENTION

The present invention relates to terminal assemblies. In particular, the present invention relates to electrical terminal assemblies that can be quickly mated to their counterparts.

BACKGROUND OF THE INVENTION

Terminal assemblies terminate a cable and adapt the cable for attachment to a device, connector, or another cable. Known terminal assemblies for threaded post connections typically include a rotating nut portion with internal threads. Such a terminal assembly with a rotating nut portion requires the nut portion to be rotated so that the internal threads of the nut portion can engage corresponding threads of the counterpart threaded post connection. To properly establish a conductive pathway, the nut portion must be fully twisted onto the corresponding threads and torqued to a predetermined value. A loose terminal assembly connection can fail to provide the positive contact needed for continuity between the terminated cable and the counterpart device, connector, or cable. Also, a loose connection can come apart and disrupt the conductive pathway to the counterpart device, connector, or cable.

Terminal assemblies for threaded post connections are often used to connect electrical cables with fuel injector assemblies of automobiles. Tools are required to grasp the rotating nut portions of the terminal assemblies because the rotating nut portions cannot be torqued to their proper predetermined values by hand. These terminal assemblies are connected to threaded post connections of respective fuel injector assemblies in an assembly line with torque wrenches. However, the torque wrenches do not ensure that each rotating nut portion is properly secured to its respective threaded post connection because a torque wrench only ensures that the rotating nut portion is fully torqued and does not ensure that the rotating nut portion is fully seated. If the rotating nut portion of the terminal assembly is twisted on the threaded post connection at an angle with respect to the threaded post connection, sometimes referred to as being "cross threaded," then the torque wrench indicates that the nut portion is fully torqued even though the terminal assembly and fuel injector assembly are not properly assembled. Also, cross threading can damage the threads of the threaded post connection, thereby causing expensive replacement or delay in manufacturing. Digital torque wrenches are available and count the number of revolutions while monitoring the torque of the rotating nut portion during assembly. However, digital torque wrenches are not always accurate, thus resulting in terminal assemblies improperly assembled with their respective threaded post connections.

Additionally, proper leverage is required to torque the rotating nut portion fully which is difficult in the confined spaces around a fuel injector assembly. Under adverse conditions, the tool cannot adequately grasp the nut portion of the terminal assembly. Without a sure grip, the tool often fails to connect the terminal assembly properly with its counterpart threaded post connection. Also, connecting terminal assemblies under adverse conditions increases the likelihood of a loose connection occurring, thus making the terminal assembly more susceptible to separation from its counterpart.

Thus, a need in the art exists for an improved terminal assembly that can be quickly and securely mated to its counterpart without measuring torque and without requiring leverage for torqueing.

SUMMARY OF THE INVENTION

Accordingly, an object of the invention is to provide a terminal assembly that can be quickly mated to its counterpart without measuring torque and without requiring leverage for torqueing. Another object of the invention is to provide a terminal assembly that securely maintains electrical contact with its counterpart. The electrical contact is maintained by the terminal assembly exerting pressure on its mated counterpart.

One embodiment of the invention provides a terminal assembly. The terminal assembly includes a terminal and a barrel. The terminal has a coupling portion that fastens to a conductor, a mating portion with compression tabs arranged to form a channel, and an interlocking member on at least one of the compression tabs. The barrel is separate from the terminal and has a bore formed therethrough configured to receive the compression tabs of the mating portion. The barrel includes an interlocking member corresponding to the interlocking member of the at least one compression tab.

Another embodiment of the invention provides a terminal assembly. The terminal assembly includes a terminal, a barrel, and an overmolding substantially surrounding the terminal and the barrel. The terminal has a coupling portion that fastens to a conductor, a mating portion with compression tabs arranged to form a channel, and an interlocking member on at least one of the compression tabs. The barrel is separate from the terminal and has a bore formed therethrough configured to receive the compression tabs of the mating portion. The barrel includes an interlocking member corresponding to the interlocking member of the at least one compression tab.

Yet another embodiment of the invention provides a method of manufacturing a terminal assembly. The method includes the steps of: forming a terminal with a coupling portion that fastens to a conductor and a mating portion with compression tabs; disposing an opening on at least one of the compression tabs; arranging the compression tabs to form a substantially circular channel; forming a barrel with a bore formed therethrough to receive the compression tabs; disposing an indent on the barrel to engage the opening disposed on the at least one of the compression tabs; and assembling the barrel to the terminal by engaging the indent with the opening.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-8, the invention provides a terminal assembly 100 that quickly and securely mates with its counterpart 300, such as a fuel injector assembly. A simple, generally uni-directional pushing motion mates the terminal assembly 100 with its counterpart 300, thus the terminal assembly 100 can be mated more securely and quicker than the known terminal assemblies with a threaded, rotating nut portion that require several revolutions to mate with its counterpart. The terminal assembly 100 also securely maintains mechanical and electrical contact with its counterpart 300 through compression tabs 126 elastically pressed against the counterpart 300. The invention also provides a method of manufacturing the terminal assembly 100 that is simpler than the known terminal assemblies that include a rotating nut portion with internal threads.

Figure 1:
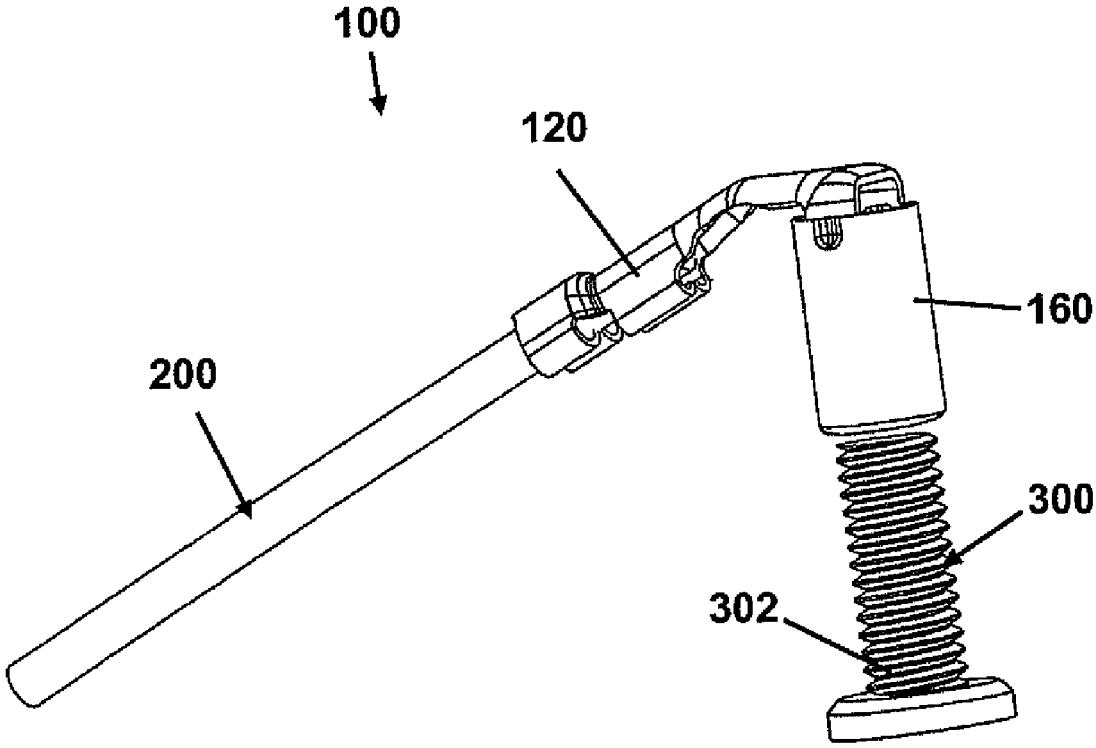
FIG. 1 is a perspective view of a terminal assembly according to an exemplary embodiment of the invention.

Turning to FIG. 1, the terminal assembly 100 is shown prior to being mated with its counterpart 300. The terminal assembly 100 provides a conductive pathway from a conductor 200 to the counterpart 300. In the embodiment shown, the counterpart 300 is a conductive post 300 with external threads 302. Although a threaded conductive post 300 is shown, the invention is not limited to threaded conductive posts 300. In other embodiments, the terminal assembly 100 can mate to conductive posts 300 with a smooth exterior, a bellowed exterior, a grooved exterior, a knurled exterior, a combination of the aforementioned, or some other feature on the external surface of the conductive post 300. Also, although the conductive post 300 shown has a substantially circular cross-sectional shape, in other embodiments, the conductive post 300 can have a cross-sectional shape that, for example, is a substantially oval shape, a polygonal shape, or some other suitable cross-sectional shape.

Figure 2:
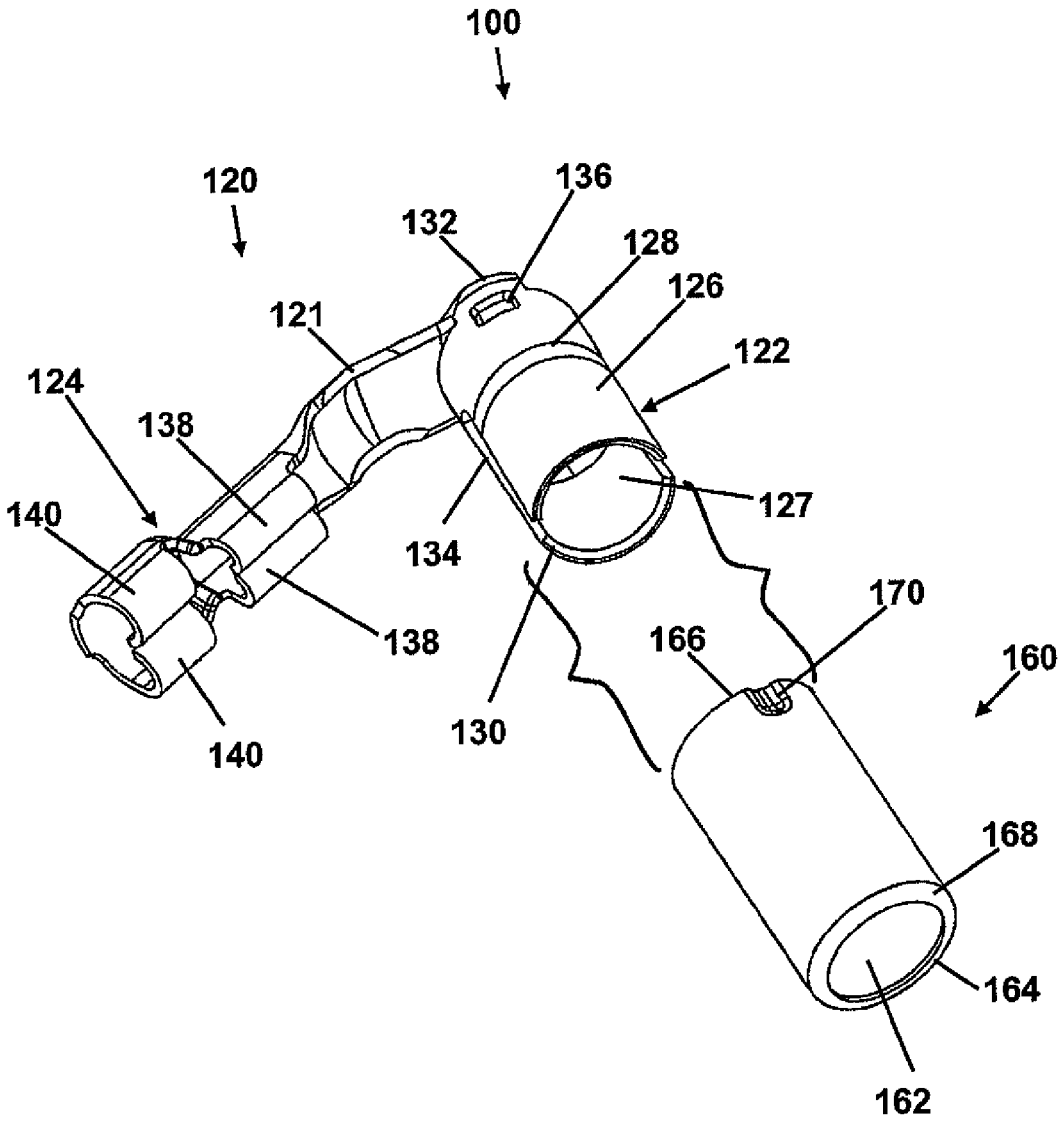
FIG. 2 is an exploded bottom perspective view of a terminal and a barrel of the terminal assembly illustrated in FIG. 1.
Figure 3:
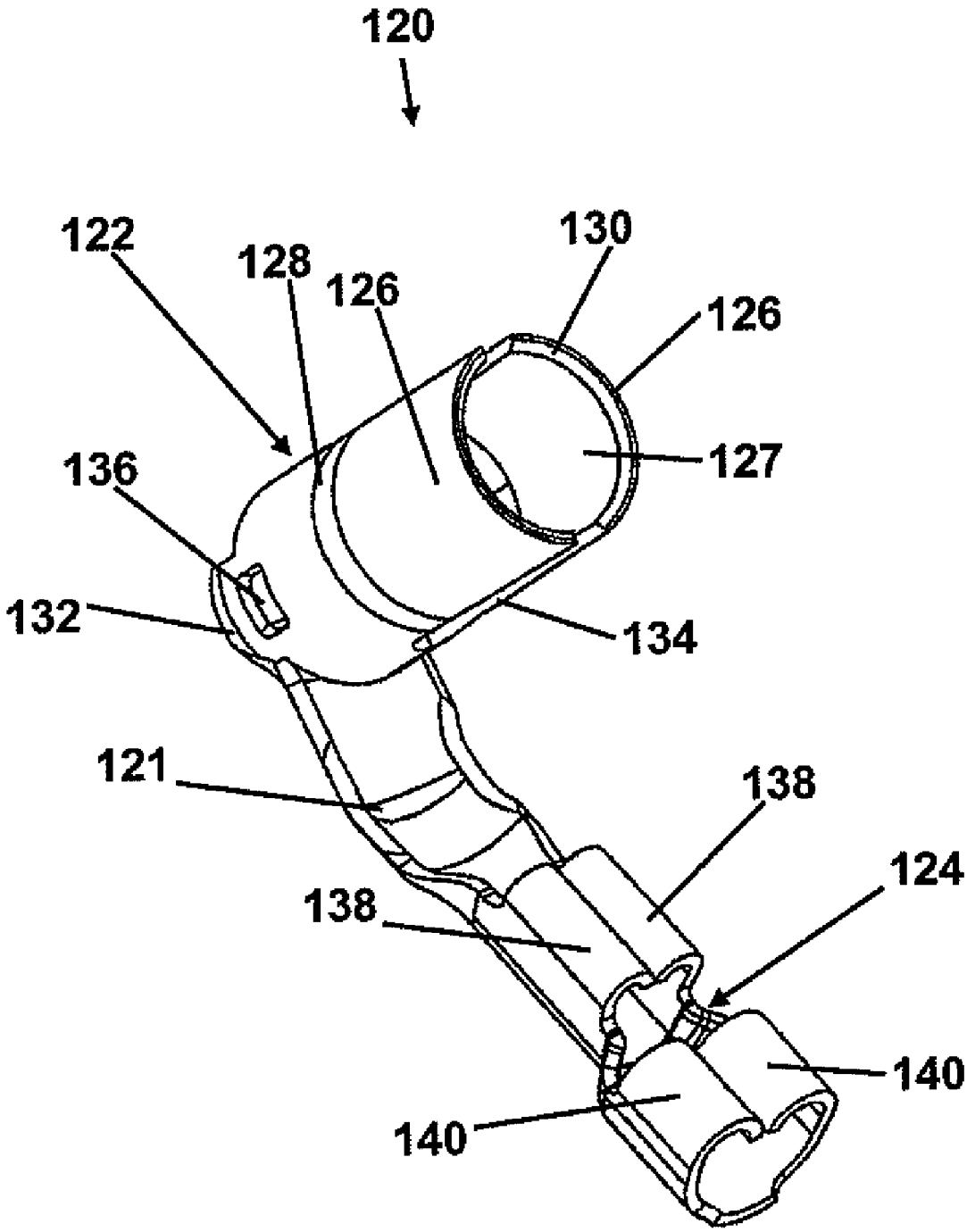
FIG. 3 is a bottom perspective view of the terminal illustrated in FIG. 2.
Figure 4:
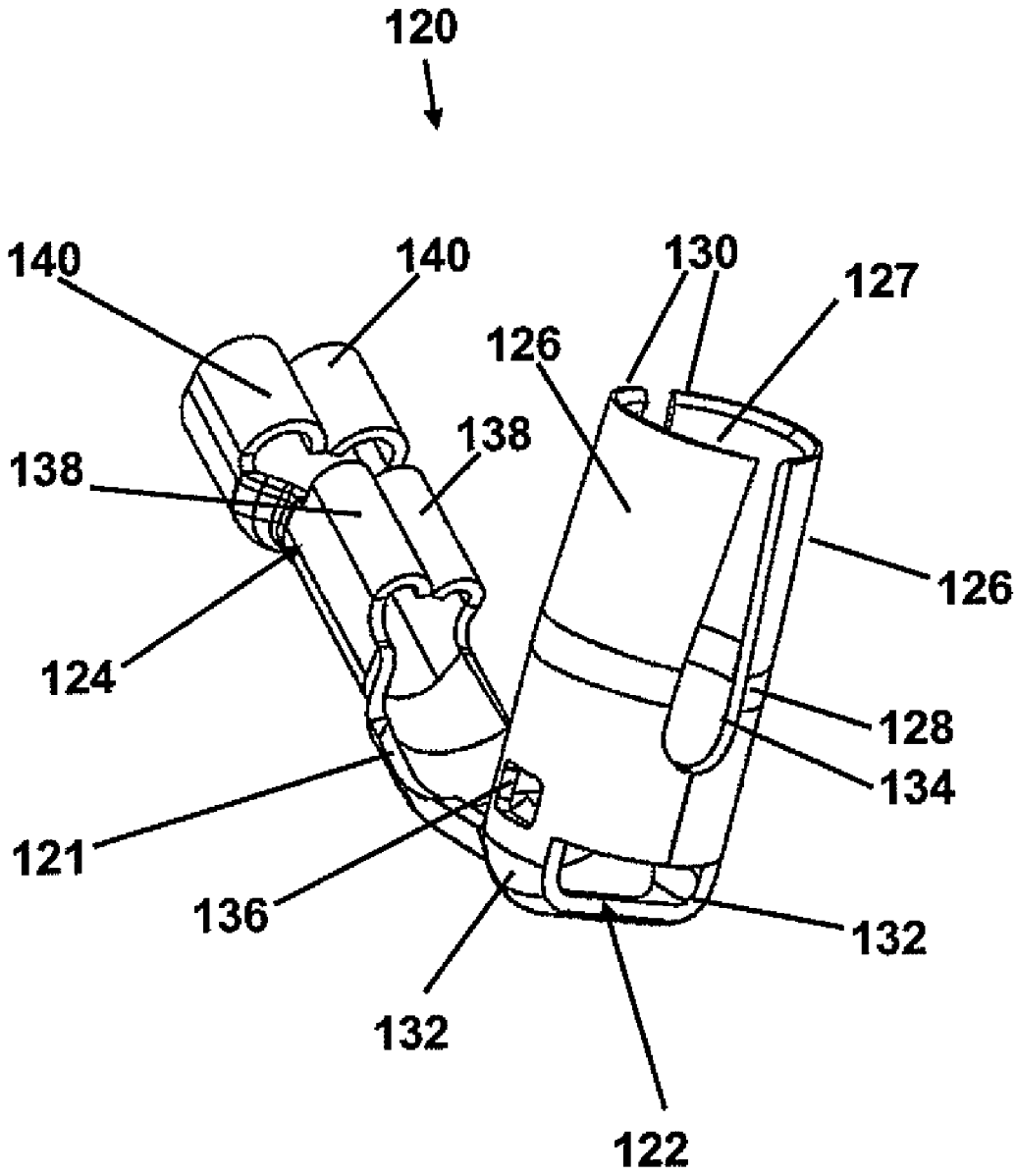
FIG. 4 is a left perspective view of the terminal illustrated in FIG. 2.
Figure 5:
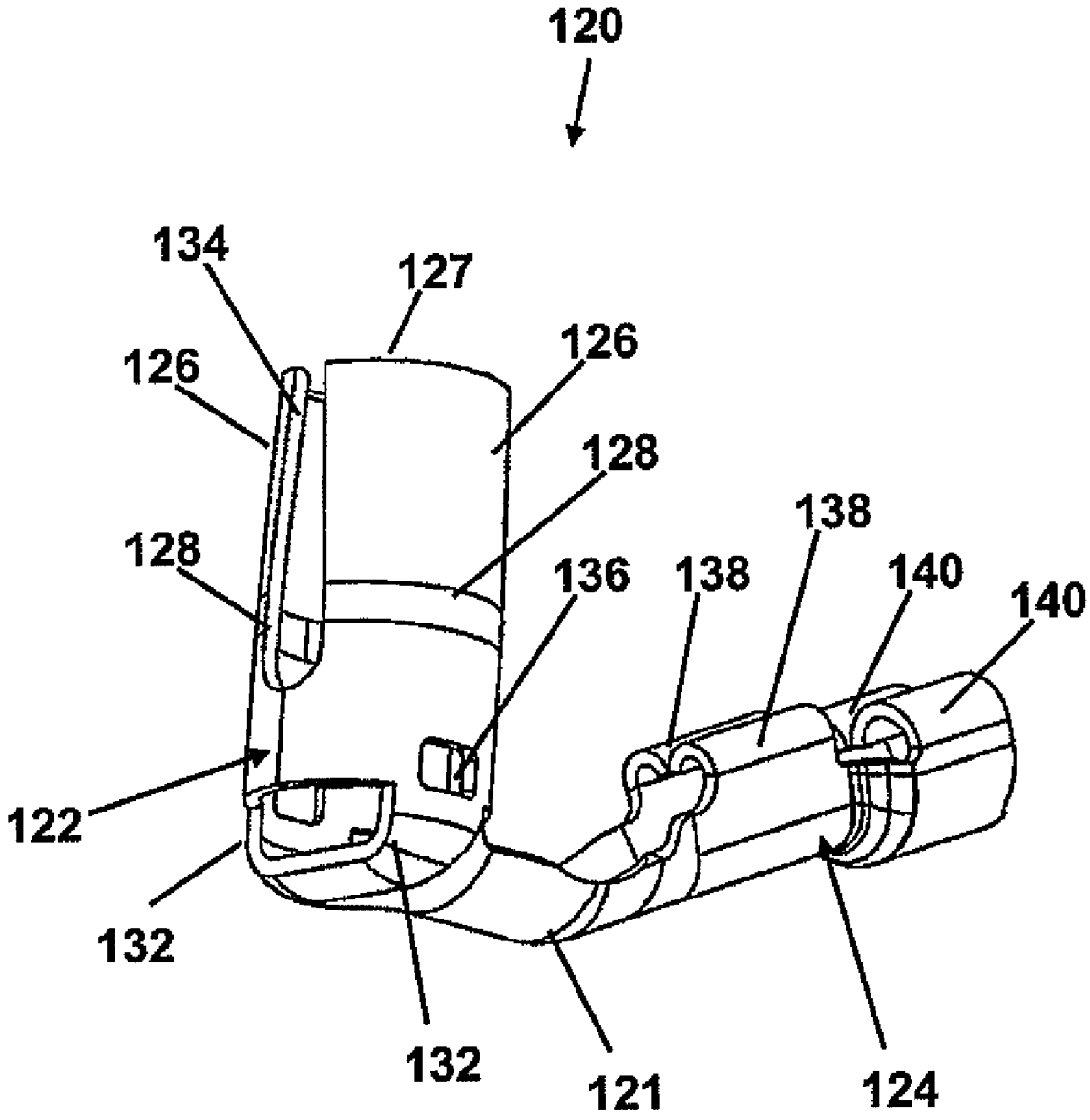
FIG. 5 is a right perspective view of the terminal illustrated in FIG. 2.

Referring to FIG. 2, the terminal assembly 100 is shown without the conductor 200 and the conductive post 300. The terminal assembly 100 includes, at least, a terminal 120 and a barrel 160. The terminal 120 may have a body 121 and a mating portion 122 that extends from one end of the body 121. The mating portion 122 mates with the conductive post 300 (shown in FIG. 1) and is substantially received within the barrel 160. The mating portion 122 of the terminal 120 may have at least one compression tab 126. In the embodiment shown, the mating portion 122 has two opposing compression tabs 126, but the number of compression tabs 126 shown is not meant to be limiting. In other embodiments, the number of compression tabs 126 may be more or less than the two compression tabs 126 shown. The compression tabs 126 provide a compression mating with the conductive post 300.

Referring to FIGS. 2-5, the compression tabs 126 each extend from the body 121 at a respective base 132. The base 132 of each compression tab 126 positions the compression tabs 126 to form a channel 127 to receive the conductive post 300. In the embodiment shown, the base 132 extends substantially perpendicular to the body 121 of the terminal 120. The compression tabs 126 may angle towards each other as the compression tabs 126 extend from the base 132. Also, adjacent compression tabs 126 have a slot 134 substantially along their adjoining edges. The slot 134 allows adjacent compression tabs 126 to deflect toward each other in the pre-mated state. Each compression tab 126 can have a bend 128 about which the compression tab 126 deflects as the channel 127 receives the conductive post 300.

Each compression tab 126 can also have a beveled edge 130 at a distal end that first receives the conductive post 300. The beveled edge 130 guides and directs the conductive post 300 to the channel 127. In the embodiment shown, the compression tabs 126 have a substantially crescent-like cross-sectional shape that face each other to form a generally circular channel 127 to receive the conductive post 300, and the compression tabs 126 have beveled edges 130 that are angled inward and toward the channel 127.

As shown in FIG. 2, the barrel 160 generally surrounds the mating portion 122 of the terminal 120 and receives the conductive post 300 so that the mating portion 122 can mate with the conductive post 300. The barrel 160 has a bore 162 that extends longitudinally through the barrel 160, thereby forming a first aperture 164 and a second aperture 166 at opposite ends of the barrel 160. The conductive post 300 is received through the first aperture 164, and the mating portion 122 of the terminal 120 is received through the second aperture 166. The diameter of the first aperture 164 is slightly smaller than the diameter of the bore 162, thus forming a flange 168 substantially along a periphery of the first aperture 164. The beveled edges 130 of the compression tabs 126 are generally adjacent the flange 168 so that the flange 168 prevents the conductive post 300 from stubbing the ends of compression tabs 126. Because the beveled edges 130 of the compression tabs 126 are adjacent the flange 168, the flange 168 aligns the conductive post 300 towards the beveled edges 130, and the beveled edges 130 guide the conductive post 300 into the channel 127. The conductive post 300 can also be beveled so that the conductive post 300 aids in guiding itself past the first aperture 164 and into the channel 127. In another embodiment, the flange 168 may be beveled so that the flange 168 guides the conductive post 300 past the first aperture 164 and into the channel 127. In the embodiment shown, the barrel 160 has a substantially elongated cylindrical shape with a bore 162 that extends longitudinally through the barrel 160, thereby forming the first aperture 164 and the second aperture 166 at opposite ends of the barrel 160. The conductive post 300 is beveled (shown in FIG. 1), but the flange 168 is not beveled.

The compression tabs 126 are received through the second aperture 166 of the barrel 160. The barrel 160 prevents the base 132 and the bend 128 of each compression tab 126 from deflecting away from the channel 127. In the embodiment shown, the base 132 and the bend 128 generally contact the inner surface of the bore 162, while substantially the remainder of the compression tab 126 is positioned away from the inner surface of the bore 162. Thus, each compression tab 126 deflects at the bend 128 when the channel 127 receives the conductive post 300.

The terminal 120 and the barrel 160 are coupled to each other. The terminal 120 and the barrel 160 can be coupled by interlocking mechanism, such as any mechanical arrangement or parts, screws, rivets, chemical adhesives, welding, or some other way or method that couples together the terminal 120 and the barrel 160. In the embodiment shown, the barrel 160 preferably has at least one interlocking member, such as an indent 170, and the terminal 120 has at least one complementary interlocking member, such as an opening 136 that receives the indent 170. In alternate embodiments, the terminal 120 can have the indent 170, and the barrel 160 can have the opening 136 instead. The indent 170 is dimensioned so that the indent 170 substantially engages the opening 136. In the embodiment shown, the opening 136 has a substantially rectangular form, and the indent 170 has a substantially rectangular form with a generally semicircular portion. In other embodiments, the opening 136 can have any other shape, and the indent 170 can be any shape that engages the opening 136. The opening 136 is placed near the base 132 of, at least, one of the compression tabs 126. The indent 170 is placed near the second aperture 166 where the barrel 160 receives the mating portion 122 of the terminal 120 so that the indent 170 engages the opening 136. In alternate embodiments, the opening 136 maybe located elsewhere, such as the compression tab 126 itself, and the indent 170 can be positioned on the barrel 160 so that the indent 170 engages the opening 136. After the compression tabs 126 are substantially received in the bore 162, the indents 170 of the barrel 160 engage respective openings 136 of the compression tabs 126.

As shown in FIGS. 2-5, the terminal 120 can also have a coupling portion 124 extending from the body 121 of the terminal 120 at an end opposite the mating portion 122. The coupling portion 124 couples to the conductor 200 (shown in FIG. 1). The mating portion 122 can be coupled by one or more crimp profiles, interlocking mechanical parts, screws, rivets, chemical adhesives, welding, or some other way or method that couples together the terminal 120 and the conductor 200. In the embodiment shown, the body 121 is formed so that the mating portion 122 and the coupling portion 124 are substantially perpendicular to each other. However, in other embodiments, the mating portion 122 and the coupling portion 124 can be at some other angle, or the mating portion 122 and the coupling portion 124 can be aligned with each other.

Also, in the embodiment shown, the coupling portion 124 has two crimp profiles 138 and 140. Crimping joins two pieces of metal or some other malleable material by deforming one or both pieces so that the two pieces are coupled to each other. The bending or the deformation is called the crimp, and it provides a rapid and lasting mechanical and electrical coupling. The crimp profiles 138 and 140 of the coupling portion 124 are bent or deformed around a stripped conductor 200 to form a mechanical and electrical coupling between the conductor 200 and the terminal 100. In the embodiment shown, the crimp profiles 138 and 140 are formed adjacent to each other and aligned with the body 131. The first crimp profile 138 is closest to the body 131 and is bent around the bare conductors of the stripped conductor 200. The second crimp profile 140 is further from the body 131 than the first crimp profile 138 and bent around the insulation of the conductor 200.

Figure 6:
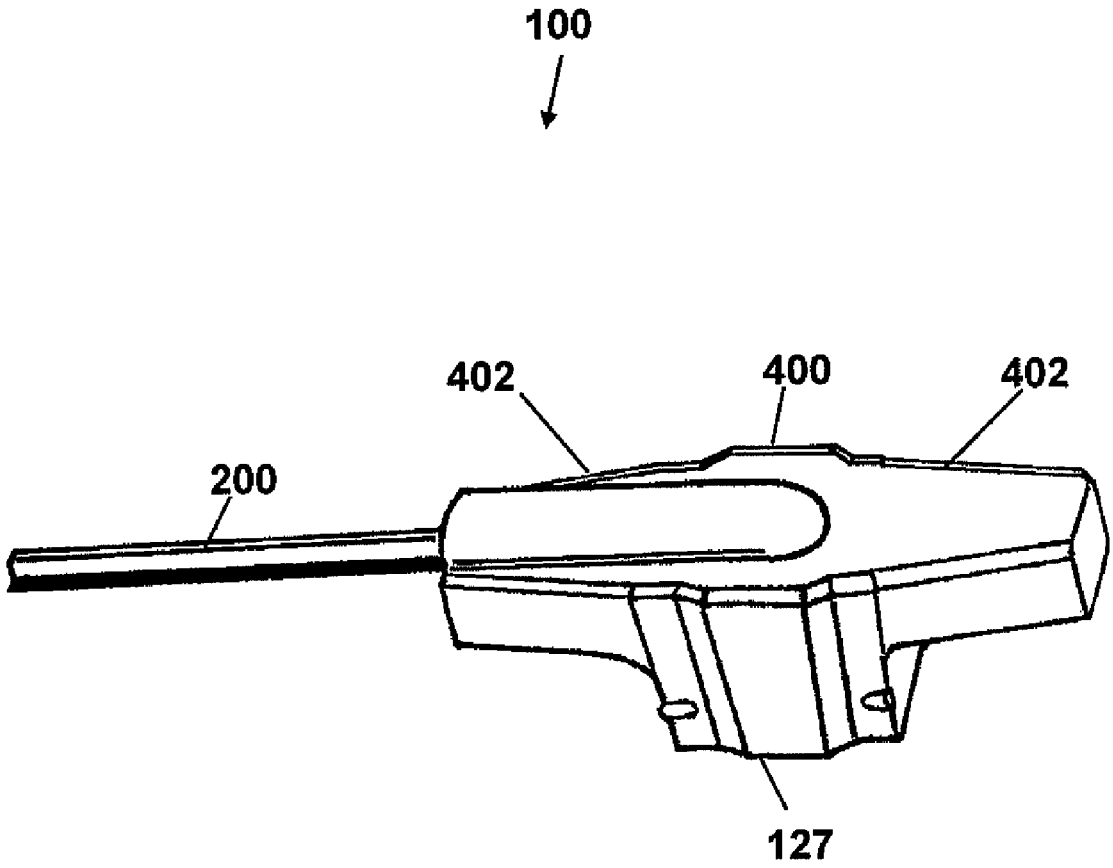
FIG. 6 is a top perspective view of an overmolding of the terminal assembly illustrated in FIG. 1.

Referring to FIG. 6, portions of the terminal assembly 100, such as the terminal 120 and the barrel 160, can be substantially overmolded with an overmolding 400 made from suitably insulative material. The overmolding 400 can substantially insulate or cover the terminal assembly 100, as shown, except for the first aperture 162 of the barrel 160, the bore 160, the compression tabs 126, and the channel 127. The insulative material can be a suitable plastic or polymer, such as polyethylene, polyethylene terephthalate, polypropylene, polyvinyl chloride, polystyrene, polyamide, polypthalamide, or other similar materials. The overmolding can also be shaped to provide better grasping of the terminal assembly 100 or to aid in the mating of the terminal assembly 100 to the conductive post 300. In the embodiment shown, the overmolding 400 has extending arms 402 that provide more surface area for a user to grasp. The extending arms 402 can also be angled with respect to the mating portion 122 and the barrel 160 so that the overmolding 400 can be received in a smaller cavity.

Figure 7:
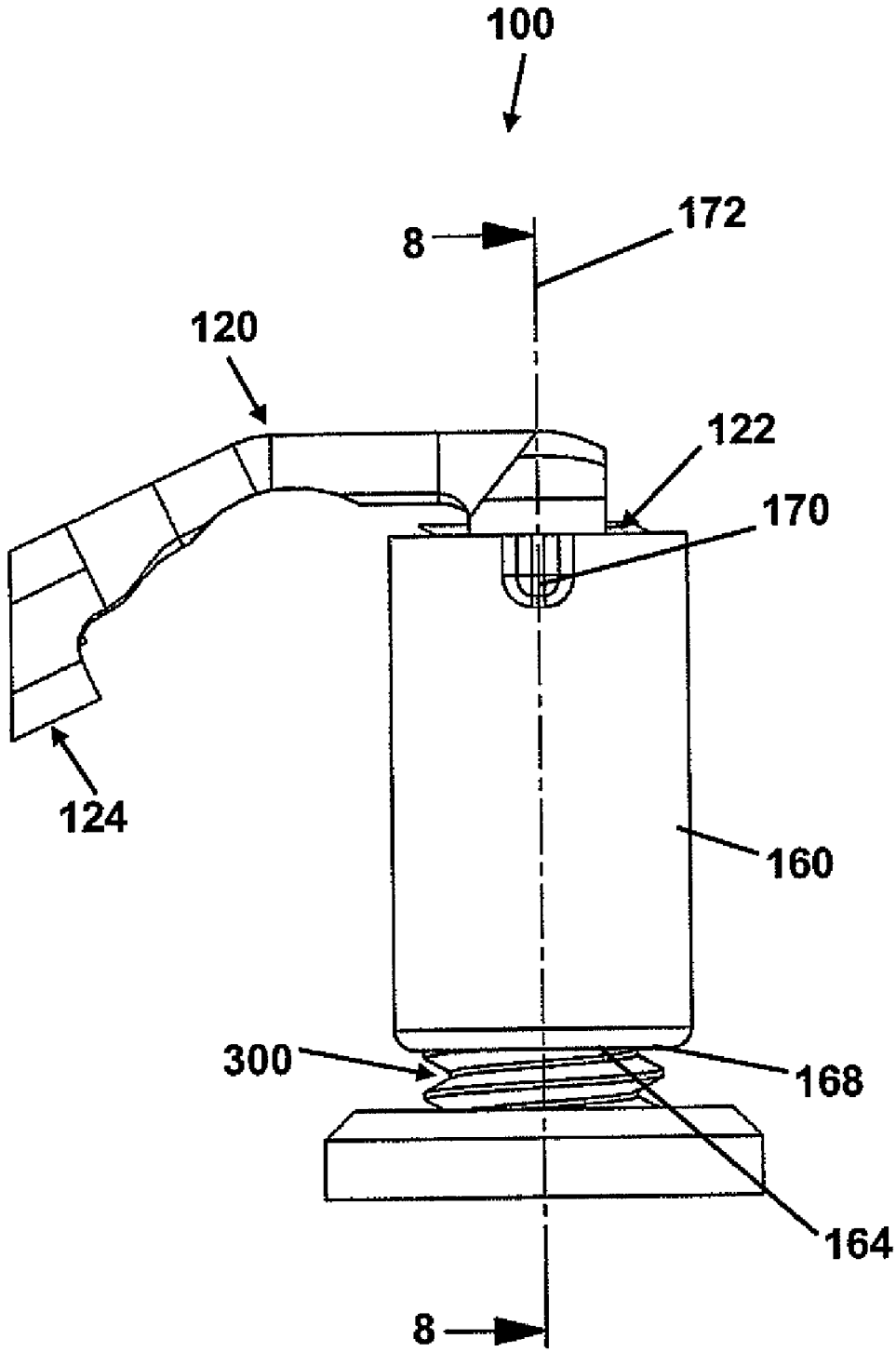
FIG. 7 is a partial side elevational view of the terminal assembly illustrated in FIG. 1 mated to a conductive post.
Figure 8:
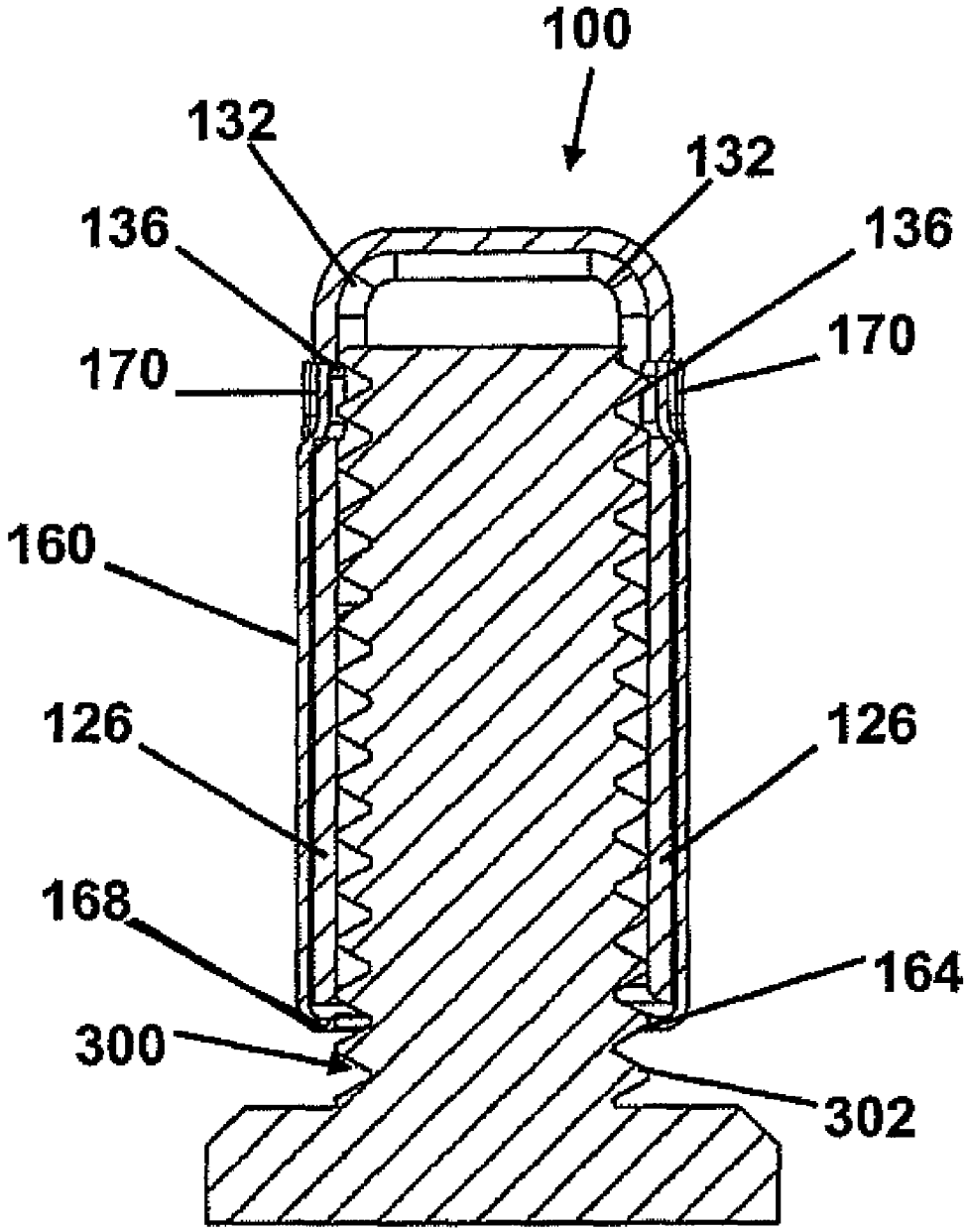
FIG. 8 is a cross sectional view of the terminal assembly and the conductive post along line 8-8 of FIG. 7.

Referring to FIGS. 7-8, the conductive post 300 is received in the bore 162 of the barrel 160 through the first aperture 164, and the compression tabs 126 of the mating portion 122 electrically and mechanically mates with the conductive post 300. To mate the terminal assembly 100 to the conductive post 300, the longitudinal axis 172 of the channel 127 and the barrel 160 is aligned with the longitudinal axis of the conductive post 300. The mating portion 124 and the barrel 160 are pushed towards the conductive post 300. As the mating portion 124 and the barrel 160 are pushed, the conductive post 300 enters the first aperture 164 of the barrel 160. The conductive post 300 slides past the flange 168, if provided, and is received in the channel 127 formed by the compression tabs 126. Bevels, if any are provided, aid in guiding the conductive post 300 into the channel 127. Because the channel 127 formed by the compression tabs 126 is smaller relative to the conductive post 300, the compression tabs 126 must elastically expand away from the channel 127 to receive the conductive post 300. In the embodiment shown, the base 132 and the bend 128 of each compression tab 126 contact the inner surface of the barrel, so that each compression tab 126 elastically deflects substantially at the bends 128 so that each compression tab 126 expands elastically away from the conductive post 300 to receive the conductive post 300 in the channel 127. However, the barrel 160 limits further outward expansion of the compression tabs 126. Because the bends 128 of the compression tabs 126 elastically compel the compression tabs 126 towards the channel 127, the compression tabs 126 press against the conductive post 300, thereby forming a mechanical and electrical coupling between the conductive post 300 and the mating portion 120 of the terminal assembly 100. Also, because the conductor 200 is electrically and mechanically coupled to the coupling portion 124 of the terminal assembly, the terminal assembly 100 provides a conductive pathway between the conductor 200 and the conductive post 300.

A method of manufacturing a terminal assembly 100 is described herein as being performed in a particular order to simplify the description of the method. However, the order in which these operations are performed is not important, and another order can work. To manufacture the terminal assembly 100 according to one embodiment, the barrel 160 is made from stock tubing material. The barrel 160 is preferably made from brass C2680, but the barrel 160 can also be made from any other suitably rigid material. The stock tubing material is formed into the barrel 160 by machining on a CNC lathe, by stamping operation, or by any other method that can form the barrel 160. The barrel 160 can be machined, stamped, formed, or otherwise processed further to include the indent 170, an opening, or some other mechanical coupling. The indent 170, the opening, or some other mechanical coupling can be disposed on the barrel 160 before or after the barrel 160 itself is formed. In the embodiment depicted, the indent 170 is formed before the barrel 160 is formed.

The terminal 120 is made from stock flat material. The terminal 120 is made from any suitably conductive and hard material. In the embodiment shown, the terminal 120 is made from copper alloy C5191 because the hardness of C5191 provides suitable elastic properties. The terminal 120 is made by feeding the stock flat material into a stamping press equipped with progressive die tooling. When made by stamping press, the terminal 120 leaves the stamping press on a carrier strip as a result of the continuous stamping operation. The stamping press can form the mating portion 122, the coupling portion 124, and the compression tabs 126 in their proper shape and orientation with respect to each other. The stamping press can also form the opening 136, an indent, or some other mechanical coupling on the terminal 120 to couple the terminal 120 to the barrel 160. The stamping press can further shape compression tabs 126 with bends 128 and bases 132. Then, automated equipment combines terminals 120 on the carrier strip with respective barrels 160 to form the terminal assemblies 100. The carrier strip can be later utilized for high-speed terminating by an automated terminating machine to couple the terminal assemblies 100 to conductors 200. Parts of the terminal assembly 100, such as the terminal 120 and the barrel 160, may be overmolded with a plastic or polymer.

As apparent from the above description, the invention provides a terminal assembly 100 that quickly and securely mates with its counterpart 300 by a simple generally unidirectional pushing motion. The terminal assembly 100 securely maintains physical and electrical contact with its counterpart 300 through compression tabs 126 elastically pressed against the counterpart 300. Thus, the terminal assembly 100 mates with its counterpart 300 without measuring torque and without requiring leverage for torqueing. The invention also provides a method of manufacturing the terminal assembly 100 that is simpler than terminal assemblies with rotating nut portions.

While a particular embodiment has been chosen to illustrate the invention, it will be understood by those skilled in the art that various changes and modifications can be made therein without departing from the scope of the invention as defined in the appended claims.

What is claimed is:

1. A terminal assembly, the terminal assembly comprising:
a terminal including,
a coupling portion that couples to a conductor,
a mating portion with a plurality of compression tabs arranged to form a channel, each of the plurality of compression tabs coupled to a respective base extending from the terminal and each of the plurality of compression tabs adapted to deflect outward away from the channel, and
an interlocking member disposed on at least one of the plurality of compression tabs; and
a barrel separate from the terminal, the barrel having a bore formed therethrough configured to receive the plurality of compression tabs of the mating portion, the barrel including an interlocking member corresponding to the interlocking member of the at least one of the plurality of compression tabs.

2. A terminal assembly according to claim 1, further comprising:
an overmolding that substantially surrounds the terminal and the barrel.

3. A terminal assembly according to claim 1, wherein the coupling portion includes a crimp coupling.

4. A terminal assembly according to claim 1, wherein the plurality of compression tabs forms a substantially circular channel.

5. A terminal assembly according to claim 1, wherein at least one of the plurality of compression tabs further comprises a bend.

6. A terminal assembly according to claim 1, wherein the interlocking member of the terminal comprises an opening.

7. A terminal assembly according to claim 6, wherein the opening is substantially rectangular.

8. A terminal assembly according to claim 1, wherein the interlocking member of the barrel comprises an indent.

9. A terminal assembly according to claim 8, wherein the indent is substantially rectangular with a generally semicircular portion.

10. A terminal assembly, the terminal assembly comprising:
a terminal including,
a coupling portion that couples to a conductor,
a mating portion with a plurality of compression tabs arranged to form a channel, each of the plurality of compression tabs coupled to a respective base extending from the terminal and each of the plurality of compression tabs adapted to deflect outward away from the channel, and
an interlocking member disposed on at least one of the plurality of compression tabs;
a barrel separate from the terminal, the barrel having a bore formed therethrough configured to receive the plurality of compression tabs of the mating portion, the barrel including an interlocking member corresponding to the interlocking member of the at least one of the plurality of compression tabs; and
an overmolding that substantially surrounds the terminal and the barrel.

11. A terminal assembly according to claim 10, wherein the coupling portion includes a crimp coupling.

12. A terminal assembly according to claim 10, wherein the plurality of compression tabs forms a substantially circular channel.

13. A terminal assembly according to claim 10, wherein at least one of the plurality of compression tabs further comprises a bend.

14. A terminal assembly according to claim 10, wherein the interlocking member of the terminal comprises an opening.

15. A terminal assembly according to claim 14, wherein the opening is substantially rectangular.

16. A terminal assembly according to claim 10, wherein the interlocking member of the barrel comprises an indent.

17. A terminal assembly according to claim 16, wherein the indent is substantially rectangular with a generally semicircular portion.

18. A method of manufacturing a terminal assembly, the method comprising the steps of:
forming a terminal with a coupling portion that couples to a conductor and a mating portion;
forming a plurality of bases, each of the plurality of bases extending from the terminal;
forming a plurality of compression tabs;
disposing each of the plurality of compression tabs at a respective one of the plurality of bases;
disposing an opening on at least one of the plurality of compression tabs;
arranging the plurality of compression tabs to form a substantially circular channel;
forming a barrel with a bore formed therethrough to receive the plurality of compression tabs;
disposing an indent on the barrel to engage the opening disposed on the at least one of the plurality of compression tabs; and
coupling the barrel to the terminal by engaging the indent with the opening.

19. A method of manufacturing a terminal assembly according to claim 18, further comprising the step of:
overmolding substantial portions of the barrel and the terminal.

20. A method of manufacturing a terminal assembly according to claim 18, further comprising the step of:
forming a bend in at least one of the plurality of compression tabs.

21. A method of manufacturing a terminal assembly according to claim 18, further comprising the step of:
forming the coupling portion as a crimp coupling.

22. A method of manufacturing a terminal assembly according to claim 18, further comprising the step of:

providing the opening with a substantially rectangular shape.

23. A method of manufacturing a terminal assembly according to claim 18, further comprising the step of:

providing the indent with a substantially rectangular shape with a semicircular portion.

* * * * *